United States Patent [19]

Fisher et al.

[11] Patent Number: 4,514,871

[45] Date of Patent: May 7, 1985

[54] WATERBED CONVERTIBLE CAP

[76] Inventors: Susan S. Fisher; Jared D. Fisher, both of 630 Ave. J, Lake Charles, La. 70601

[21] Appl. No.: 523,302

[22] Filed: Aug. 15, 1982

[51] Int. Cl.[3] ..... A61G 7/10

[52] U.S. Cl. ..... 5/508; 5/424; 5/400; 5/451; 5/193; 248/345.1; 29/450

[58] Field of Search ..... 5/424, 451, 452, 508, 5/400–402, 409, 460, 193; 297/DIG. 6; 248/345.1; 29/428, 450

[56] References Cited

U.S. PATENT DOCUMENTS

| | | | |
|---|---|---|---|
| 2,713,892 | 7/1955 | Knapp | 248/345.1 |
| 3,050,746 | 8/1962 | Mikesell | 5/193 |
| 3,695,690 | 10/1972 | Carson | 297/DIG. 6 |
| 4,103,375 | 8/1978 | Santo | 5/451 |
| 4,109,887 | 8/1978 | Wakeland, Jr. | 5/400 |
| 4,190,916 | 3/1980 | McMullan | 5/401 |
| 4,370,373 | 1/1983 | Janicz | 248/345.1 |

OTHER PUBLICATIONS

"Softrails", Flotation Sleep Industry Oct., 1982, p. 63.

*Primary Examiner*—Gary L. Smith
*Assistant Examiner*—Michael F. Trettel
*Attorney, Agent, or Firm*—Keaty & Keaty

[57] ABSTRACT

A universal, convertible, padded end cap for a water bed railing permits the joining of a supplementary end rail to any of a number of available padded water bed side rail designs providing in each case a smooth, decorative, functional corner joint and seal. This cap has significant strength for retaining the rails in a rigidly locked position relative to one another during use of the bed, resisting the forces imposed by persons climbing into and out of the bed across the padded rails; it also provides a decorative and pleasing appearance, matching that of the end rails used. The cap, which is included with the padded end rail in construction, is a mitered, sewn fabric extension from a padded end rail, being designed to match in appearance the end rail and the side rails, and particularly mitered in cut so as to enclose the side rails being sealed to the side rails by using a series or sequence of fasteners, which, together with the overall cut of the convertible cap, creates a tight, secure, yet flexible continuous corner joint between the side and end rails.

6 Claims, 5 Drawing Figures

WATERBED CONVERTIBLE CAP

BACKGROUND OF THE INVENTION

This invention relates to the field of water beds and more particularly to the type of padded side rails which have been developed for installation on the frames holding water beds to provide a more pleasing appearance, to secure the water bed in position, and to provide a more comfortable surface for persons entering or leaving the water bed.

A standard water bed in essence consists of a rectangular frame, most often built of vertical wood sections having a uniform thickness and having the appearance of wide planks. The primary purpose of the water bed frame is to structurally retain and hold an inner liner which is filled with water. Unlike conventional beds which have relatively soft mattress sides rising above their frames, a water bed side frame must extend to the top of the water bed mattress to provide sufficient retention strength to hold the liner in place. As a result, a person climbing into or out of a water bed contacts the side rail or the side frame which is a particularly hard and unyielding material having relatively sharp corners.

As a result, a specific sub-technology has grown up in water beds for the construction of various decorative and padded end rails or rail caps which serve the twin purposes of protecting the user against the hard edges of the water bed frame by providing a soft and yielding surface, and, at the same time, providing a more pleasing appearance to the water bed.

Typical of such retainer caps or rails caps is that shown in U.S. Pat. No. 4,109,887 of Wakeland which shows a plurality of methods for retaining a water bed cap upon a rail. Similarly, U.S. Pat. No. 4,089,497, Miller, shows an alternate method of retaining a padded cap upon a water bed rail.

U.S. Pat. No. 4,103,375, Santo, shows a particular type of water bed frame. U.S. Pat. No. 3,973,282, May, includes in its description and drawings a good representation of the most common water bed frame technique now in use. U.S. Pat. No. 4,109,887, Wakeland, also includes a good description of the state of the art in water bed frames and rails. U.S. Pat. No. 3,840,921, LaBianco, shows one alternate water bed frame member.

SUMMARY OF THE INVENTION

The current invention relates to the various end caps or rail caps shown in the prior art and available on the market. It is customary, within the water bed market, to sell a water bed frame having a decorative structure at the head and the foot of the bed, and providing only two padded rail caps for the side rails. The retention for these rail caps has been a problem in the prior art; the prior art provides many solutions, such as keyed grooves, or spring clips, provided within the side rails themselves.

These side rails may be of a number of cross sectional configurations. They are generally shown to be a rather rigid rail securing member for clamping over the bed frame. A padded material covers the rigid member for absorbing shocks and blows and imparting softness; this padded material is most often one of the closed cell plastic foams such as urethane foam; a covering is fastened by stitching over the entire rail. The ends of the rails are most often square cut as they are intended to abut against a structure expected to be found at the foot of the water bed. A mitered cut end or end providing any sort of a locking means to a foot rail is not commonly found, and, if found, would only be compatible with a predesigned end rail cap.

If no end rail cap has been so provided, a bed owner, who wishes to avoid a foot structure, is faced with the problem of obtaining a usable end rail cap. This invention therefore deals with the situation in which no mating end rail cap has been provided. It is the intention of this invention to provide a method for adapting a universal end rail cap to any of the commonly available or commercially available side rail caps providing thereby a secure, structurally retentive corner joint, preserving a decorative appearance compatible with that of the side rail caps, and adapting to the side rail caps of any design.

It is also an object of this invention to provide a particularly universal end rail which will mate with any of a number of side rails creating a smooth uniform appearance around the frame of the waterbed, and providing a smooth decorative joint, adjoining the end rail to the side rails.

It is a further object of this invention to provide an end rail cap which may be secured to a water bed without requiring structural modification to the frame of the water bed and without requiring fasteners or physical protrusions into the contents of the water bed.

It is the further object of this invention to provide an adaptive end rail cap having all of the above properties as will be hereinafter described.

DETAILED DESCRIPTION OF THE DRAWINGS

DETAILED DESCRIPTION OF THE PREFERRED EMBODIMENT

Figure 1:
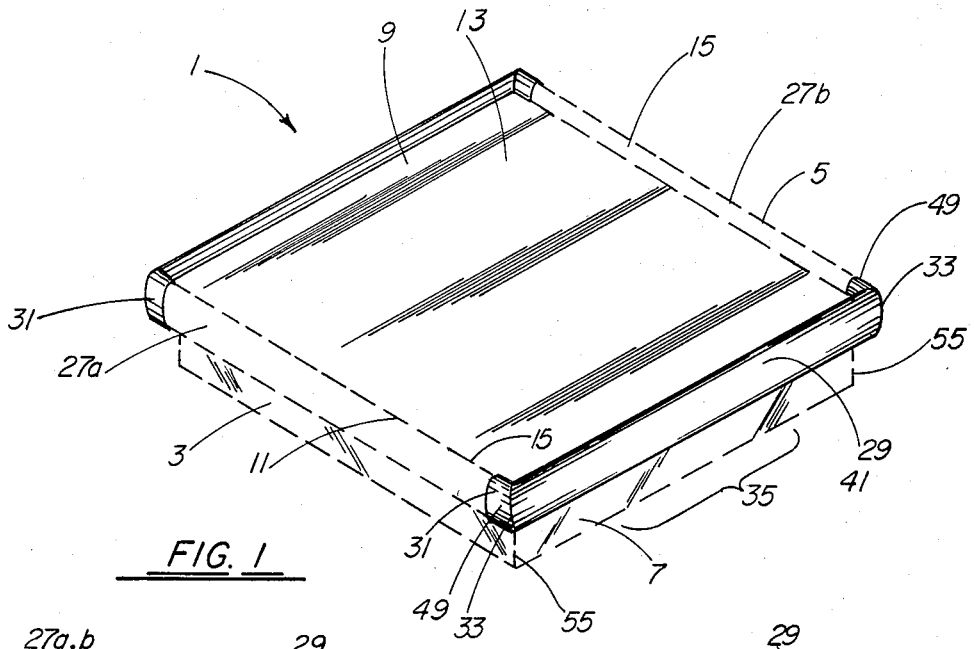
FIG. 1 depicts a perspective view of a typical water bed frame, with rail caps installed.

Referring first to FIG. 1 the typical water bed frame 1 is shown comprising an essentially rectangular structure constructed of two side rail members 3, 5 and two end rail members 7, 9 each of which has at its upper edge an essentially rectangular cross section being substantially thinner than its height. Within this frame 1 is contained a water bed liner 13 which is a flexible membrane or bag filled with water (not shown). The structural forces tending to spread the water bag out horizontally are such that the upper edge is of the side and end rails 3, 5, 7, 9 must be substantially level with the top of the water bag 13 when the water bag 13 is filled and thus the upper edge 15 of the rails and the upper end or top of the water bag 13 are at substantially the same level.

A person entering a water bed must climb over or otherwise rest parts of his body upon these rails 3, 5, 7, 9. Because the rails 3, 5, 7, 9 as provided for the strength of the water bed are rigid, unyielding, substantially uncomfortable sections, it is therefore universally common to provide at least along the sides of the water bed a padded rail cap 29 or 27*a, b.*

Figure 3:
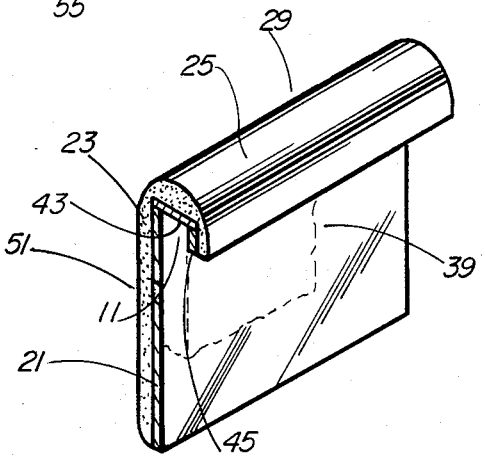
FIG. 3 is a view of a side rail cap.

The padded rail caps 29 or 27*a, b* come in several configurations but, as shown in FIG. 3, all essentially comprise an inner rigid structure 21 matedly adapted to enclose and rest upon the upper ends 11 of a rail. Optionally these rail caps would include fastening means or clamping means (not shown) for more securely locking themselves to the side rails. The outer surface of these rail caps is then provided with a resilient material for padding and comfort 23, most commonly one of the urethane foams. Then an outer fabric covering 25, typically of naugahyde, or similar vinyl or plastic materials, is stitched to the rigid inner frame 21 of the rails 3, 5, 7, 9 so as to completely enclose the resilient foam 23 and which provides a pleasing appearance and a smooth comfortable texture to the touch.

It is often found that a water bed will be sold only with two side rail caps 27*a, b*. The ends 31 of the side rail caps 27*a, b* may be stitched shut or may simply be opened. The corner ends 33 of the side rails 3 and 5, that is, the ends adjacent to the foot 35 of the water bed, are most often put in a square configuration, as it is expected by the manufacturer that a footpiece (not shown) similar to a headboard but smaller will be provided as an accessory for the waterbed.

If such a footpiece is not provided, the foot rail 7, that is, the water bed frame rail at the foot 35 of the water bed, is left exposed; the provided side rail caps 27*a, b* merely terminate at an end 33 adjacent to the foot 35 of the bed.

Figure 2:
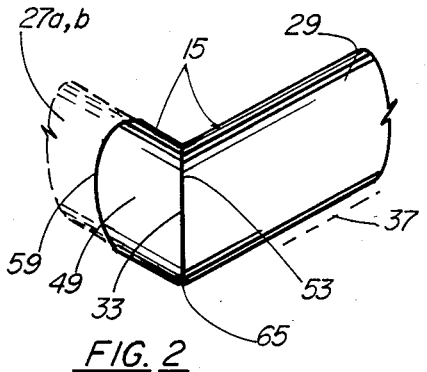
FIG. 2 is a partial view of a convertible cap installed connecting an end rail cap end and a side rail cap end.

FIGS. 2, 3 show an embodiment of the current invention. A padded rail is provided to enclose the foot rail 7 of the water bed frame 1. This padded rail comprises an inner mating frame 21 adapted to the rail 7. This inner mating frame 21 comprises an outer vertical section 39 for contacting the outer face 41 of the foot rail 7; a top cross section 43 extending horizontally across the top of the foot rail and a downwardly extending inner section 45 which serves as a lip for retaining the rail cap 29 upon the bed rail 7 extending downwards a distance along the inside of the bed rail 7 of the water bed frame 1. A covering of urethane foam 23 is provided along the outer surface of the rail cap 29; a vinyl or similar cloth covering 25 to match the fabric and texture of the covering of the existing side rail caps 27*a, b* is stitched along the outside of the foam padding 23, extending from along the bottom most extension of the outer vertical frame 39 to the lower edge of the inner cap down side inner section 45 so as to completely enclose the visible exterior of the rail cap 29.

This water bed cap 29 does not have mitered corners; it is given square corners designed to extend across to the edge defined by the outer most dimension of the existing side bed rails 3, 5 at the corners formed with the foot rail 7 of the water bed. Thus at each end of the provided foot rail cap 29, the outer frame 39 and top cross frame section 43 extend outwardly for a distance. The provided end rail cap 29 extends outwardly along beyond the extent of the provided foot rail to an imaginary line 47 along a surface extending along the outermost edge of the existing side rail caps 27*a, b*. In practice, the outer downward section 39 and the top cross section 43 of the inner frame 21 of the foot rail cap 29 extend beyond the inner lip 45 of the foot rail cap 29 on each side by a distance substantially equal to the thickness of the side rails 3, 5 of the water bed frame 1. The provided footrail cap 29 further extends to the line 47 created by the outer edge of the existing side rail caps 27*a, b* by extending the inner foam padding 23 such a distance.

At each end of the foot rail cap 29 is then provided an extended fabric section 49 of the same material as is used in the outer covering of the foot rail cap 29. This extended fabric section or convertible corner cap 49 is cut and attached in the following manner.

It is readily seen that there are two outer edges 51 of the foot rail cap covering 25 corresponding to the rail ends 33. At each of these outer edges 51 of the outer fabric covering 25 of the foot rail cap 29 there is provided a stitched seam 53 or similar fabric attaching seam 53 extending substantially from a point in contact with an inner corner 55 formed by the side 3, 5 and the foot rail 7 of the water bed frame 1 along outwardly and up the outer surface of the end rail cap 29 then inwardly along the end rail cap in a line forming approximately a forty-five degree angle or miter. Thence, down and in, along the inner extending surface of the end rail cap 29 to a point adjacent to the inner corner 57 formed by the inner surfaces of the water bed side rail 3, 5 and end rail 7, 9 or foot rail 29.

Figure 4:
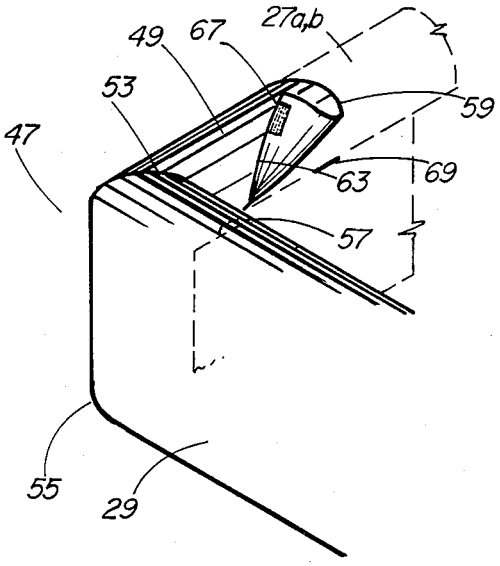
FIG. 4 is a view of the inner fastener means of the convertible cap.
Figure 5:
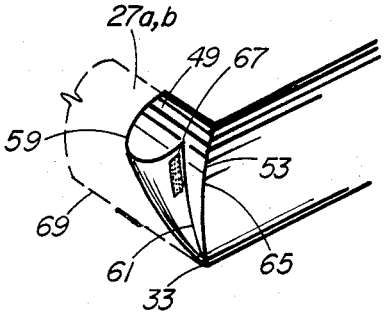
FIG. 5 is a view of the outer fastener means of the convertible cap.

Attached at this miter seam 53 is a convertible corner cap 49, as seen in FIGS. 4, 5 comprising a section of fabric of the type used to cover the rail caps 27*a, b* and 29. This fabric is cut, having a first straight or outer edge 59 substantially equal in length to the width of the cloth covering of the side rail caps 27*a, b*. Two straight edges 61, 63 perpendicularly extend from this outer edge 59 for a distance equivalent to a significant percentage, up to ten percent, of the length of the side rail 27. A fourth or curved edge 65 extending from an end of the second straight edge 61 across and then smoothly curving outwards and then smoothly curving again inwards to the end of the third straight edge 63. This curve is equivalent to that curve generated by the unfolding of the miter seam 53 provided at each of the outer covering ends 51 of the foot rail cap 29.

The convertible corner cap 49 is attached to the foot rail cover 25 along the mitered seam 53, for example by sewing. The end rail cover 25 mates with the curved edge 65 of the convertible corner cap 49 and matches to the miter. This attachment thus creates a cloth extension 49 of the end rail cap cover 25 having a configuration, outer and inner dimension size, and appearance identical to that of the end rail cap cover 25, extending at a ninety degree angle to the end rail cap 29, and conformably curving so as to enclose the side rail cap 27*a, b*. The second and third straight edges 61, 63 of the convertible cap correspond to run along and are adjacent to the inner and outer lengthwise edges (not shown) of the outer covering of the side rails caps 27*a, b*.

Along these edges of the convertible cap, on the surface of the convertible cap adjacent to the outer surface of the side rail caps 27*a, b* are provided a plurality of fasteners 67 which in the preferred embodiment consists of a strip of hook and eye material such as Velcro extending essentially the length of the edges 61, 63 of the convertible corner cap 49. Matching fasteners 69, or in the preferred embodiment a mating section of hook and eye fastener, are attached by any of the standard means, such as a vinyl compatible glue, to the edges of the side rail cap 27 cover corresponding to the edges 61, 63 of the convertible cap 49.

In operation the end cap 29 is provided as a unit of a size adapted to the standard water bed sizes; as for regular beds, water beds come in a small number of standardized dimensions corresponding basically to such commercially available sizes of kingsize, queensize, or doublesize. These dimensions are well known to all those familiar with the art of water beds, and provide a uniform sizing for various suppliers including manufacturers of liners, sheets blankets and other accessories.

An end rail cap 29, constructed as described and cut to a standard size as appropriate before is placed over the bare foot rail 7, 9 of a water bed. Each convertible corner cap sections 49 is pulled and extended along existing, provided side rail caps 27*a, b.* The corner caps 49 are stretched taunt; the fasteners 67 are then engaged lengthwise with the mating fasteners 69 along both the inner and outer extreme edges of the side rails 27, fastening a sequence from adjacent to the end rail cap 29 along to the outer edge 59 of the convertible corner cap 49 so as to provide maximum tension along the convertible corner cap 49.

This sequence, being done with both convertible corner caps 49 along both side rails 27*a, b* provides a tight, surface tensioned joint firmly affixing the end rail cap 29 to the side rail caps a, b. It provides a smooth, uniform appearing, relatively strong joint between the side rails 27*a, b* and the end rail 29. It has been found that it is unnecessary to provide any particular attaching means for the end rail cap 29 itself to the frame end rail 7, as a substantially extensive fastening force between the convertible cap 49 and the cover of the side rails 27*a, b* is transmitted by surface pull through the convertible corner cap 49 via the cover of the end rail cap to provide a strong clamping force, resisting any movement or loosening of the end rail cap 29.

As can be seen from the above detailed description the provided end rail cap 29 therefore need only be compatible with the appearance of the fabric used on the side rails. There is no need to mechanically match a particular frame rail to rail cap. This permits easy construction of end rail caps to match any of a number of side rail sizes and shapes. Further, inasmuch as the outer dimensions of the end rail cap are established as much by the extension of the foam padding to the ends of the end rail as by the actual hard physical dimensions of the frame, there is a sufficient degree of flexibility in size as to provide an extra tolerance in installation. A smooth joint is obtained by tensioning the convertible cap, compensating for considerable variance in the thickness and size of the side rail caps. This installation tolerance only exists because of the particular design of the convertible corner cap, the use of the extensively long rail fastening means along two parallel edges of the convertible corner cap, and the transmission of all joint locking and securing forces along the outer surface of the convertible cap into the outer surface of the end rail cap. The tolerance and cutting problems involved in creating the rigid mechanical joint, taught by the furniture maker's art, which would include the inner frame work of the side rail cap and the inner frame work of the end rail cap, which includes the use of mitered joints, close tolerance cutting of materials are eliminated. No longer must the end rail cap be specifically designed for each and every variety of side rail cap encountered, and the corresponding creation of a multiplicity of end rail cap styles to match the existing multiplicity of the side rail cap clamping, keying, or locking means. Formerly, it would be necessary for every end rail cap to be custom made to match a specific side rail cap. The current invention on the other hand allows a relatively limited number of end rail caps of a general size and shape to be created and sold for addition to any size rail cap as an after installed item.

It can thus be seen that the above described invention includes not only the specific embodiment particularly described but in fact a large range of flexible equivalents providing the combination of stressed skin joint and wide tolerance mating.

What is particularly claimed is:

1. A padded rail cap for a water bed, comprising:

an elongated first rail cap means extending in covering relationship substantially the length of a first rail;

a corner cap means extending perpendicularly to the first rail cap means and at least in part covering a second rail, which is attached, perpendicularly, to the first rail;

said corner cap means and said rail cap means meeting in a mitered joint at the point of attachment of two rails; said corner cap means being provided with attachment means to securely, fittingly engage a rail cap means of the second rail.

2. The padded rail cap of claim 1, wherein the first rail cap means comprises:

an inner frame means adapted to be mounted on the waterbed rail;

a foam liner means covering said inner frame means;

an outer cover means, enclosing said foam liner means, fixably attached to the inner frame means along its horizontal edges.

3. A universally adaptable end rail cap for a water bed having a pair of pre-existing side rail caps and the like comprising:

an inner hook-sheet cap frame extending laterally along the substantial extent of an existing water bed frame foot rail having an outer downward portion, a top cross portion, and an inward downward lip;

a padding fastened in covering relationship to said cap frame;

fabric covering means fastened to the foot rail cap frame, covering substantially all of the padding, a pair of extension corner means perpendicularly attached to opposite ends of the foot rail cap and each comprising:

i. a horizontal extension of the padding a distance beyond the end of the foot cap rail frame;

ii. a fabric extension meeting in a mitered joint with the foot rail cap fabric covering means, extending thereby perpendicularly from the ends of the foot rail cap for a substantial distance, enclosing thereby a proportionately substantial length of a pre-existing side rail outer cover;

a plurality of fastening means extending along an innermost and an outermost edge of the provided fabric extension; and a plurality of mating fastening means, adapted to mate with the fastening means provided along two edges of the fabric extension, provided lengthwise along the inner and outer edges of the side rail caps.

4. The universal end rail cap as described in claim 3, wherein the plurality of fastening means further comprises:

a first and a second strip of hook and eye fasteners extending substantially the length of the inner most and outer most edges of the provided fabric extension; and mating first and second stip hook and eye fastener extending substantially along the inside and outside of adjacent portions of each of the provided side rail caps adapted to securing the cloth extension of the end rail cap tensionably thereto.

5. A method for providing a joint between a padded end rail cap and a padded side cap for a waterbed or the like, each having a fabric cover, comprising:

cutting a section of fabric compatible with the fabric used for the outer cover of end rail cap or the side rail cap;

providing a mitered seam joint between the fabric section and an end of the cover of the end rail cap such that the fabric section extends perpendicularly to the end rail cap;

providing along two parallel extending edges of the fabric section a length of a continuous fastener means;

providing along the inner and outer edges of the end of the side rail cap a mating, adaptably engaging, continuous fastening means adapted to engage the fastening means provided on the cloth section; and securing the cloth extension to the side rail cover by sequentially engaging the fastening means from a point adjacent to the end cap, along the fastening means to a point away from the end rail cap, wherein the cloth cover is secured under tension.

6. A padded corner cap for a water bed, having padded rail caps, comprising:

a pair of end cap means perpendicularly attached to each other and meeting in a mitered seam joint at one of their ends;

said end cap means extending along perpendicularly adjoining rail caps of the water bed at their second ends to overlap at least in part the padded rail caps of the water bed;

said end cap means being provided with fastener means attachable to fastener means provided on said padded rail caps of the water bed.

* * * * *